US005562465A

United States Patent [19]

Taguchi et al.

[11] Patent Number: 5,562,465

[45] Date of Patent: Oct. 8, 1996

[54] LEVER-TYPE CONNECTOR

[75] Inventors: Naoto Taguchi; Hiroki Takahashi, both of Shizuoka, Japan

[73] Assignee: Yazaki Corporation, Tokyo, Japan

[21] Appl. No.: 390,796

[22] Filed: Feb. 17, 1995

[30] Foreign Application Priority Data

Feb. 18, 1994 [JP] Japan ..... 6-021338

[51] Int. Cl.[6] ..... H01R 13/62

[52] U.S. Cl. ..... 439/157; 439/160

[58] Field of Search ..... 439/152–160, 439/372

[56] References Cited

U.S. PATENT DOCUMENTS

| | | | |
|---|---|---|---|
| 5,482,394 | 1/1996 | Shinchi et al. | 439/157 |
| 5,484,297 | 1/1996 | Takahashi et al. | 439/157 |
| 5,496,187 | 3/1996 | Shinchi et al. | 439/157 |

*Primary Examiner*—David L. Pirlot
*Attorney, Agent, or Firm*—Sughrue, Mion, Zinn, Macpeak & Seas

[57] ABSTRACT

To provide a lever-type connector which is low in cost, and facilitates an operation of confirming an incompletely-fitted condition of the connector. Fixed shafts are formed on a male connector to be fitted in a female connector, and a retaining lever is mounted on the female connector for pivotal movement about pivot shafts formed respectively on opposite sides thereof, and spring engagement protections are formed respectively on the opposite sides of the female connector. Retaining grooves each having a play region are formed in a front portion of the retaining lever, and leaf springs are provided at a rear side of the retaining lever. When the retaining lever is pivotally moved, with the fixed shafts received respectively in the retaining grooves, the leaf springs respectively engage the spring engagement projections to be resiliently deformed, so that the fixed shafts are moved toward the play regions, respectively, and as a result the retaining lever is inclined in a conspicuous manner.

12 Claims, 5 Drawing Sheets

LEVER-TYPE CONNECTOR

BACKGROUND OF THE INVENTION

1. Field of the Invention

This invention relates to a lever-type connector which is used mainly for connecting wire harnesses in an automobile together, and can be operated with a low insertion/withdrawal force.

2. Related Art

One well-known conventional connector of this type (as disclosed in Japanese Patent Unexamined Publication No. 4-87169) utilizing a spring is shown in FIGS. 9 and 10.

During the time when male and female connectors 101 and 102 are brought from a half-fitted condition (FIG. 9) into a completely-fitted condition (FIG. 10), a tapering engagement portion 105 of a lock projection 104 of a cam lever 103 pivotally mounted on the connector 102 slidingly engages a tapering engagement portion 109 of a lock portion 108 of a lock arm 107 of the connector 101 to depress the lock portion 108, and when the completely-fitted condition is to be achieved, the lock projection 104 slides past the lock portion 108 to engage a lower surface of the lock portion 108, thereby completely retaining the two connectors as shown in FIG. 10.

Here, if the cam lever 103 is disposed in a lowered position when the two connectors 101 an 102 are half fitted together, the connector 101 is prevented from advancing, and can not be inserted further.

Therefore, when the fitting of two connectors 101 and 102 is to be initiated, the operator must manually hold the cam lever 103 in an initial raised position, and in this condition the connector 101 must be fitted into the connector 102. This operation is cumbersome.

Therefore, in order to avoid such inconvenience, in the conventional lever-type connector, a coil spring (resilient member) 106 is mounted on a shaft portion of the cam lever 103 to urge the cam lever 103 into its initial upstanding position.

When the two connectors 101 and 102 are in an incompletely-fitted condition, the lock portion 108 does not reach a position where it retains the lock projection 104, and therefore the cam lever 103 is kept raised under the influence of the coil spring 106. This serves as an effective means for telling the operator of the incompletely-fitted condition.

Problems to be solved by the Invention

When the incompletely-fitted condition (half-fitted condition) is encountered during the above connector fitting operation, the retaining lever (the cam 1ever 103 in the above example) is kept raised so as to tell the operator of the incompletely-fitted condition. Therefore, in this construction, the spring (the coil spring 106 in the above example) must be additionally used. Moreover, in the conventional construction, the step of attaching the spring is added, and the cost is increased because of the increased labor, which has resulted in a problem that it is difficult to provide the connector at low costs.

SUMMARY OF THE INVENTION

The present invention has been made in order to overcome the above problems and drawbacks, and an object of the invention is to provide a lever-type connector which is low in cost, and facilitates an operation of confirming an incompletely-fitted condition during a connector fitting operation.

The above object has been achieved by a lever-type connector characterized in that the connector comprises a pair of connectors to be fitted together; fixed shafts are formed respectively on opposite sides of one of the connectors while pivot shafts are formed respectively on opposite side of the other connector; a retaining lever separate from the other connector is mounted on the other connector so as to pivotally move about the pivot shafts; the retaining lever has retaining grooves into which the fixed shafts are retainingly fitted, respectively, from a front side of the retaining lever; a play region is provided at each of the retaining grooves; resiliently-deformable member, which is resiliently deformable in accordance with the pivotal movement, is mounted integrally or separately on one of the retaining 1ever and the other connector, one end of the resiliently-deformable member being able to be held by limiting means mounted on the other of the retaining lever and the other connector; the connector having the fixed shafts is fitted in the connector having the retaining lever mounted thereon; and when the retaining lever is pivotally moved forwardly, with the fixed shafts received respectively in the retaining grooves, the resiliently-deformable member is resiliently deformed by the limiting means, so that a restoring force of the resiliently-deformable member causes the fixed shafts, received respectively in the retaining grooves, to move toward the play regions, respectively, thereby inclining the retaining lever in a conspicuous manner.

The lever-type connector is also characterized in that spring engagement projections are provided adjacent to the pivot shafts of the other connector, respectively; leaf springs are formed at a rear side of the retaining lever in a projected manner; and when the retaining lever is pivotally moved forwardly, with the fixed shafts received respectively in the retaining grooves, the leaf springs engage the spring engagement projections, respectively, to be resiliently deformed, so that restoring forces of the resiliently-deformed leaf springs cause the fixed shafts, received respectively in the retaining grooves, to move toward the play regions, respectively.

One connector, having the projected, fixed shafts at its opposite sides, is inserted into the other connector having the separate retaining lever mounted thereon by the pivot shafts-provided at the opposite sides thereof, and when the retaining lever is pivotally moved forwardly, with the fixed shafts received respectively in the retaining grooves in the retaining lever, the resiliently-deformable member, which is mounted integrally or separately on the retaining 1ever, and can be held at its one end by the limiting means mounted on the other connector, is resiliently deformed in accordance with the pivotal movement, so that the restoring force thereof causes the fixed shafts, received respectively in the retaining grooves, to move respectively toward the play regions of the retaining grooves, thereby inclining the retaining lever in a conspicuous manner.

When the retaining lever is pivotally moved forwardly, with the fixed shafts received respectively in the retaining grooves in the retaining lever, the leaf springs, provided at the rear side of the retaining lever, respectively engage the spring engagement projections, provided adjacent to the pivot shafts-of the other connector, to be resiliently deformed, so that the restoring forces of the resiliently-deformed leaf springs cause the fixed shafts, received respectively in the retaining grooves, to move toward the play regions, respectively.

DETAILED DESCRIPTION OF THE PREFERRED EMBODIMENTS

One preferred embodiment of the present invention will now be described with reference to FIGS. 1 to 8.

Figure 1:
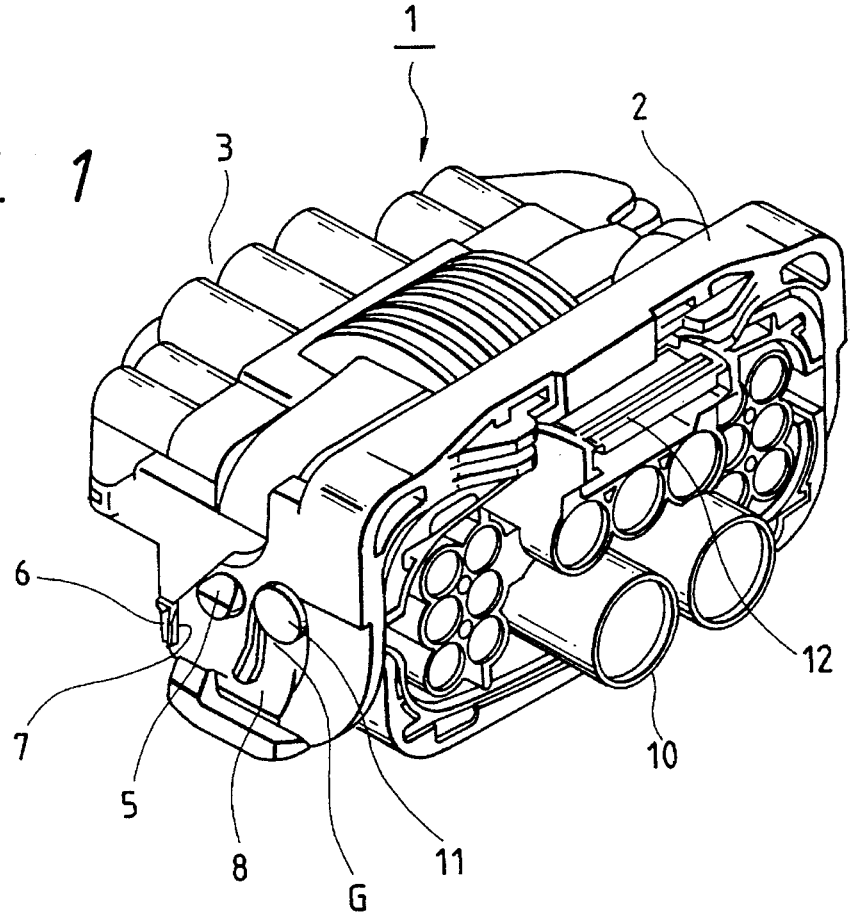
FIG. 1 is a perspective view of one preferred embodiment of a lever-type connector of the present invention.

FIG. 1 is a perspective view of a lever-type connector of the present invention.

In this Figure, the lever-type connector 1 comprises a pair of female and male connectors 3 and 10 to be fitted together, and a retaining lever 2 mounted on the female connector 3. FIG. 1 shows a condition in which the male connector 10 is inserted and fitted in the female connector 3 having the retaining lever 2 mounted thereon, and the retaining lever 2 is pivotally moved to properly retain the two connectors.

Figure 2:
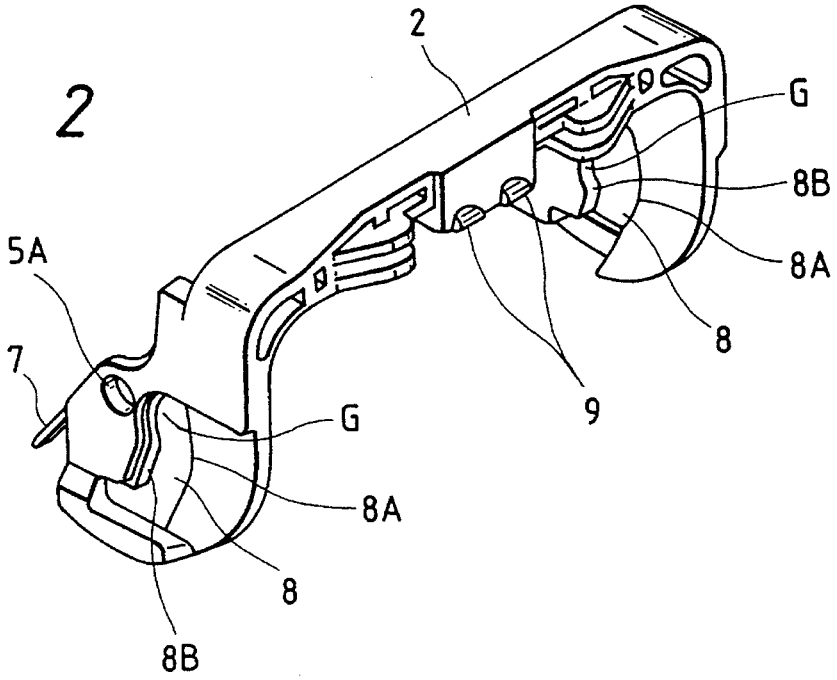
FIG. 2 is a perspective view of a retaining lever of FIG. 1.
Figure 3:
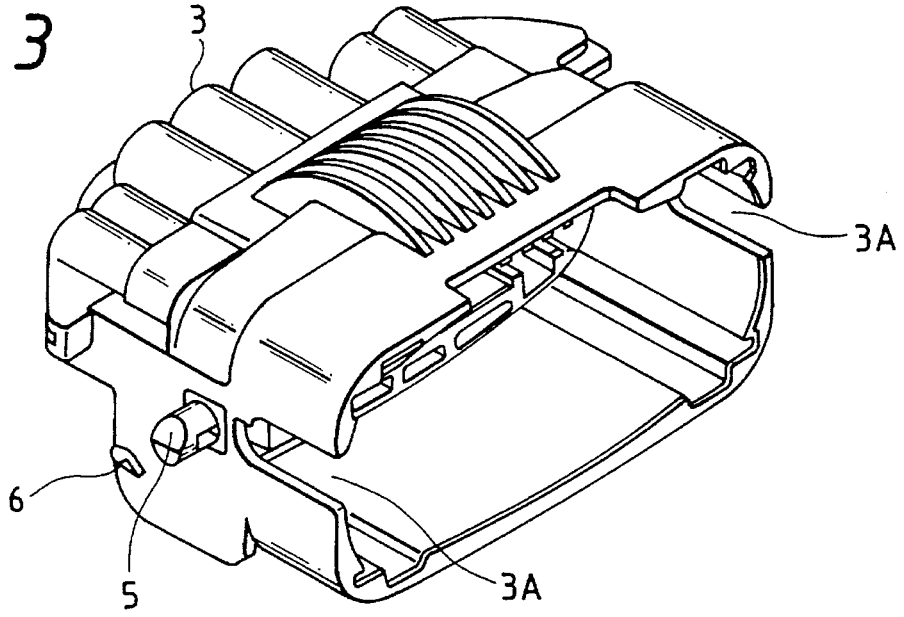
FIG. 3 is a perspective view of a female connector of FIG. 1.

FIG. 2 is a perspective view of the retaining lever of FIG. 1, and FIG. 3 is a perspective view of the female connector of FIG. 1.

In FIGS. 1 to 3, fixed shafts 11 are formed on and project from opposite sides of the male connector 10, respectively, and the separate retaining lever 2 is mounted on the female connector 3 for pivotal movement about pivot shafts 5 formed respectively on opposite sides of the female connector. Pivot shaft holes 5A for respectively passing the pivot shafts 5 therethrough, as well as retaining grooves 8 for respectively retainingly receiving the fixed shafts 11 from a front side (lower side in FIG. 2), are formed in opposite sides of the retaining lever 2. The retaining groove 8 is generally in the form of a slit having such a width as to receive the fixed shaft 11, and has a play region G along one side edge thereof to provide an increased width.

Figure 4:
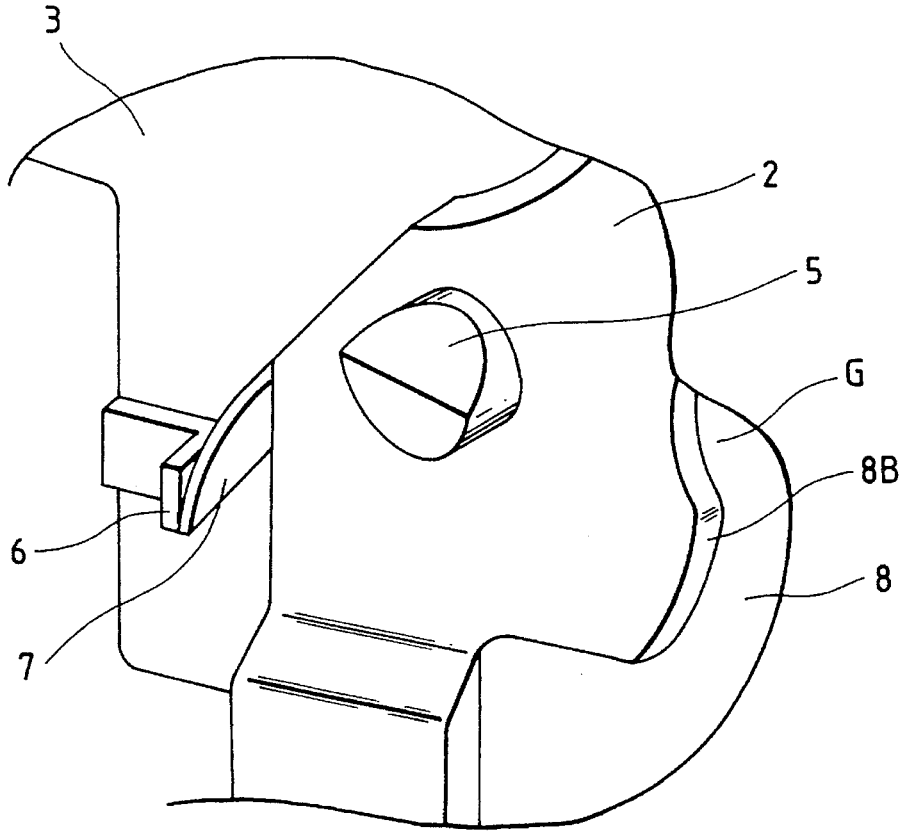
FIG. 4 is an enlarged perspective view showing a spring engagement portion and a leaf spring.

A spring engagement projection 6, serving as means for limiting the pivotal movement of the retaining lever 2, is provided at each side of the female connector 3 in the vicinity of the pivot shaft 5, and a leaf spring 7, serving as resiliently-deformable member, is formed integrally with the retaining lever 2, and projects from a rear side of the retaining lever 2. The leaf spring 7 serving as the resiliently-deformable member is held at its one end by the spring engagement projection 6 (the limiting means) provided on the female connector 3, and is resiliently deformed in accordance with the pivotal movement of the retaining lever 2. Although the leaf spring 7 serving as the resiliently-deformable member is formed integrally with the retaining lever 2, a separate leaf spring may be mounted on the retaining lever. FIG. 4 is an enlarged perspective view showing the spring engagement projection and the leaf spring. The spring engagement projection 6, serving as the limiting means, and the leaf spring 7, serving us the resiliently-deformable member, coact with each other, and therefore instead of providing the spring engagement projection 6 and the leaf spring 7 respectively on the female connector 3 and the retaining lever 2 as described above, the spring engagement projection 6 and the leaf spring 7 may be provided on the retaining lever 2 and the female connector 3, respectively.

Fitting grooves 3A are formed in the opposite sides of the female connector 3, respectively, and when the male connector 10 is inserted and fitted, the fixed shafts 11 are engaged respectively in the retaining grooves 8 through the respective fitting grooves 3A.

Figure 5:
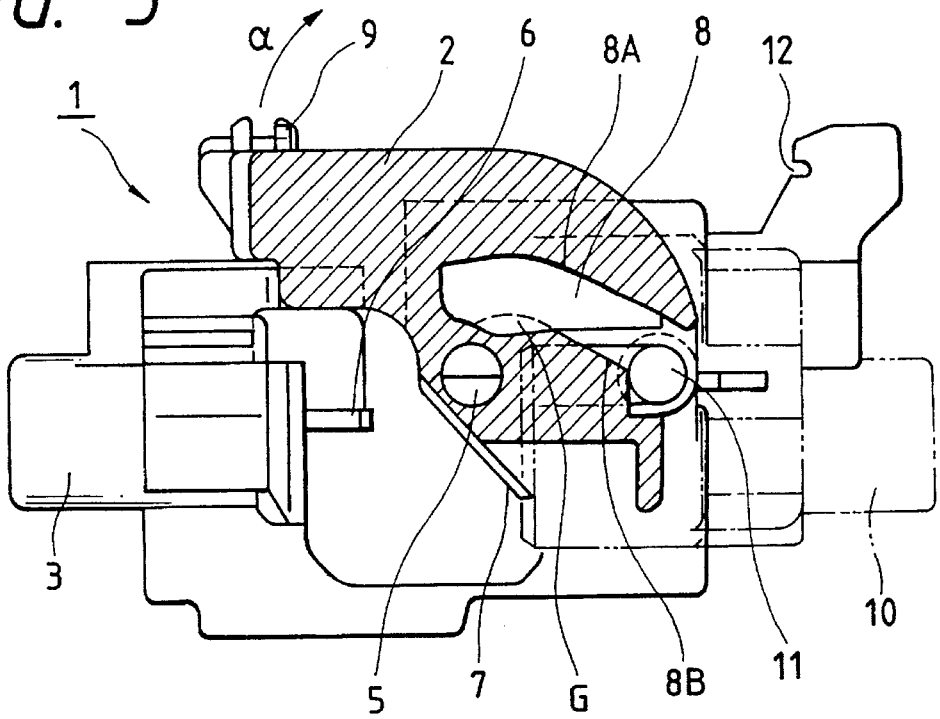
FIG. 5 is a side-elevational view showing a provisionally-fitted condition of the lever-type connector of FIG. 1.
Figure 6:
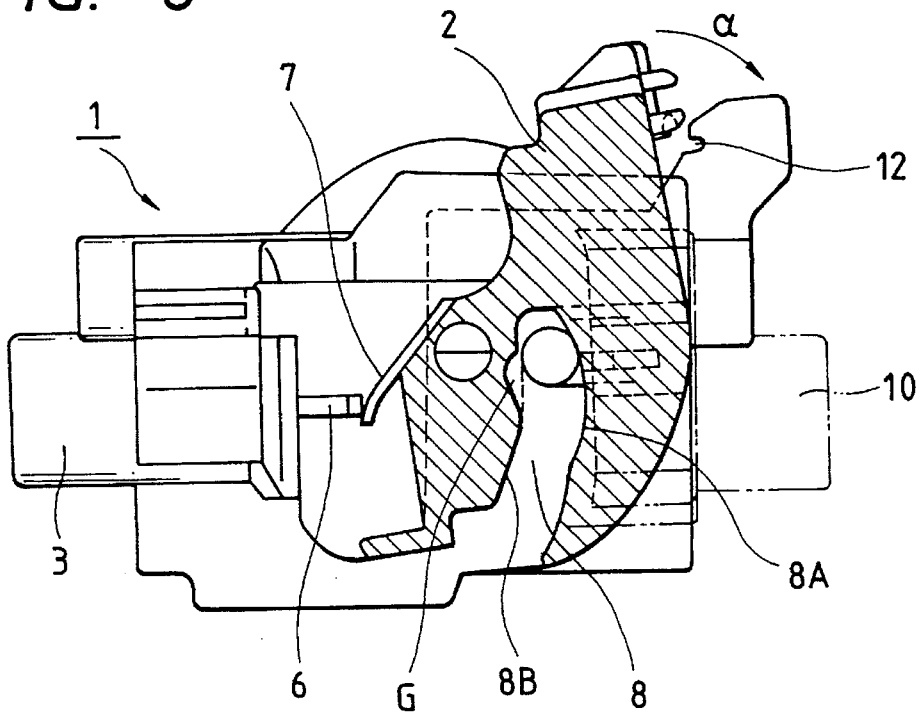
FIG. 6 is a side-elevational view showing a process of achieving a completely-fitted condition of the lever-type connector of FIG. 1.

The operation of the lever-type connector of the present invention will now be described with reference to FIGS. 5 to 8 which are side-elevational views showing a sequential fitting operation of this lever-type connector. FIG. 5 is a side-elevational view showing a provisionally-fitted condition of the lever-type connector of FIG. 1. FIG. 6 is a side-elevational view showing a process of the completely-fitting operation of the lever-type connector of FIG. 1.

In the provisionally-fitted condition of FIG. 5, the retaining lever 2 is disposed in a raised condition, and the male connector 10 is disposed in a generally normal fitted position. Therefore, each fixed shaft 11 is located at an inlet of the associated retaining groove 8.

In FIG. 6, the male connector 10 having the fixed shafts 11 is inserted into the female connector 3 having the retaining lever 2 mounted thereon, and when the retaining lever 2 is pivotally moved forwardly (that is, in a direction with the fixed shafts 11 received in the respective retaining grooves 8, each fixed shaft 11 engages an engagement wall 8A of the associated retaining groove 8, and moves toward the inner end of the retaining groove 8 along this wall 8A. Then, each leaf spring (the resiliently-deformable member) 7, provided at the rear side of the retaining lever 2, is brought into engagement with the spring engagement projection (the limiting means) 6.

Figure 7:
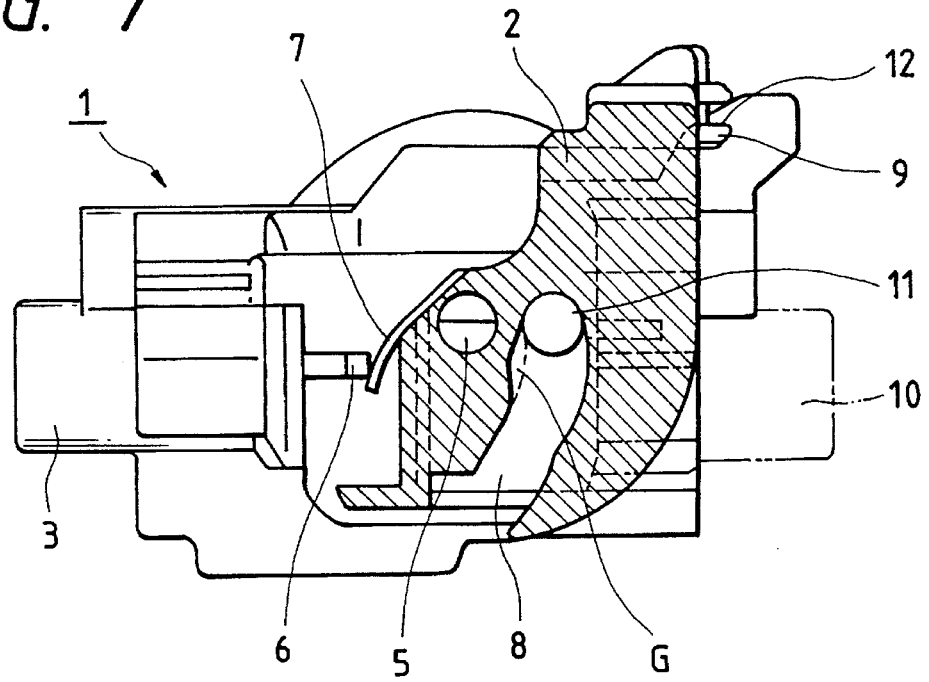
FIG. 7 is a side-elevational view showing the completely-fitted condition of the lever-type connector of FIG. 1.
Figure 8:
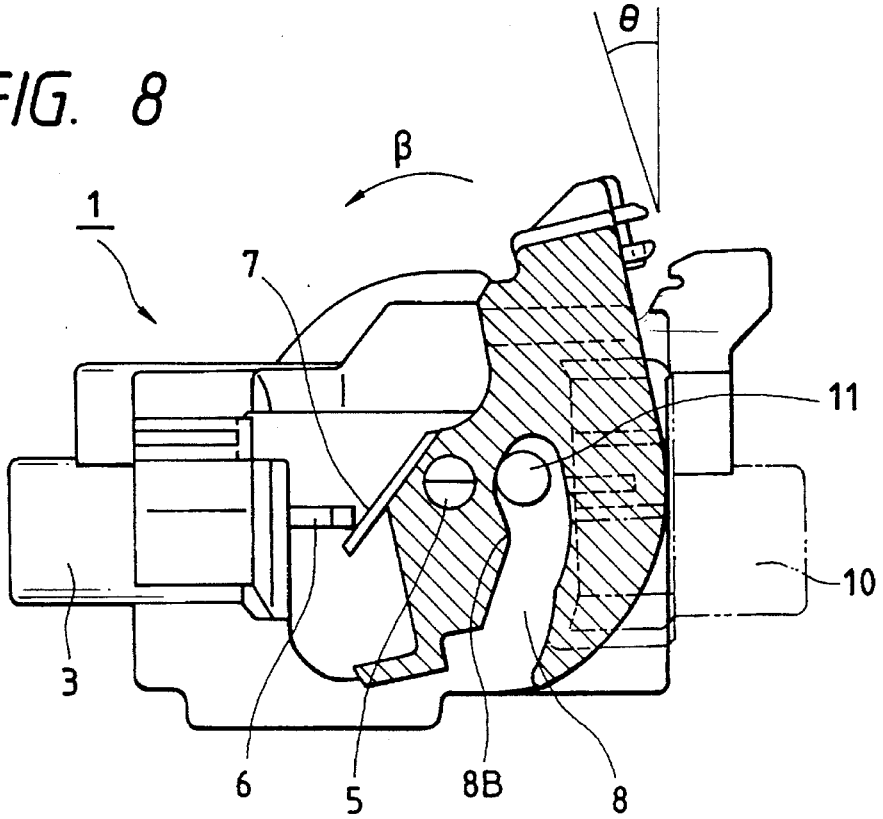
FIG. 8 is a side-elevational view showing a semi-completely fitted condition of the lever-type connector of FIG. 1.
Figure 9:
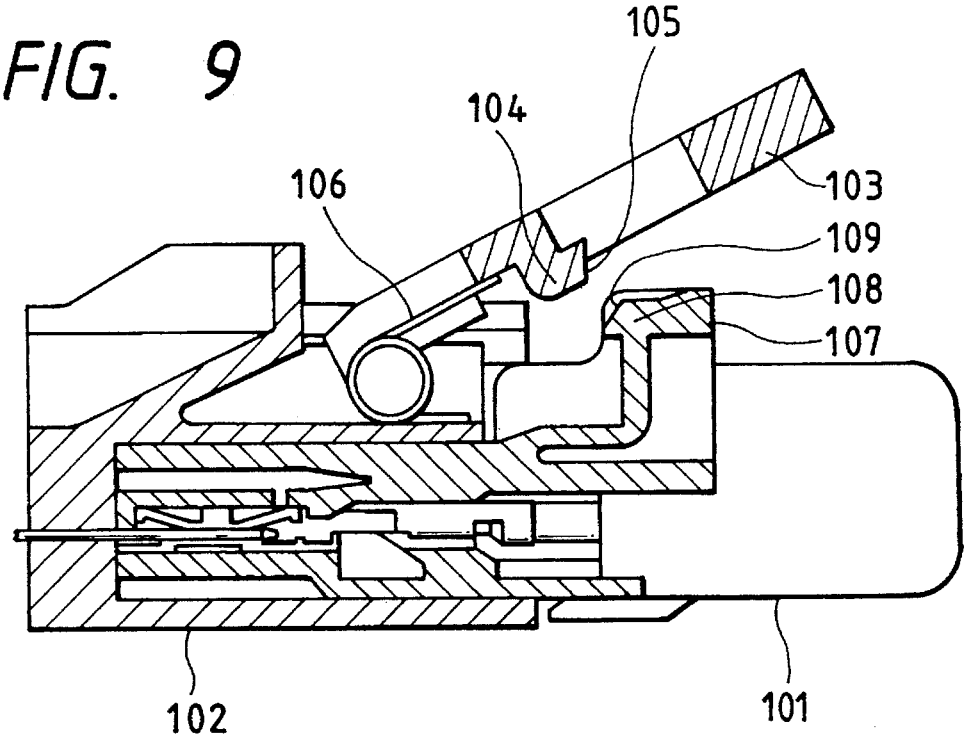
FIG. 9 is a cross-sectional view of a conventional connector of the spring lever type.
Figure 10:
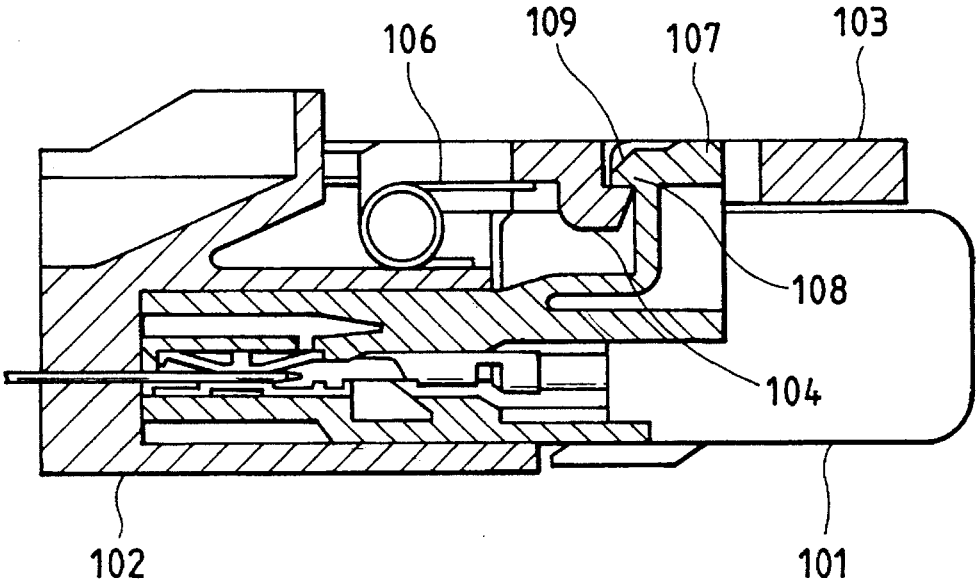
FIG. 10 is a cross-sectional view of the conventional connector of the spring lever type in a fitted condition.

When the retaining lever 2 is further forcibly moved pivotally in the direction $\alpha$, the leaf spring (the resiliently-deformable member) 7 is flexed or resiliently deformed by the spring engagement projection 6, as shown in FIG. 7. When this retaining lever is further forcibly moved pivotally to achieve the completely-fitted condition, the fixed shaft 11 is fitted in the innermost portion of the retaining groove 8, and at this time a lock projection 9 of the retaining lever 2 is engaged in a lock receiving groove 12 in the male connector 10, thereby achieving a stably-locked condition.

However, here, if the female and male connectors 3 and 10 are disposed in an incompletely-fitted condition (FIG. 8) for some reason such as an operation mistake, the retaining lever 2 fails to be pivotally moved into the predetermined position, so that each fixed shaft 11 does not reach the innermost portion of the retaining groove 8, and also the lock projection 9 of the retaining 1ever 2 is not engaged in the lock receiving groove 12 in the male connector 10. On the other hand, since each leaf spring 7 is resiliently deformed by the spring engagement projection 6, the retaining lever 2 is subjected to a force (which is produced by this resiliency) tending to pivotally move this lever in a reverse direction $\beta$.

Here, if the retaining lever 2 is slightly pivotally moved in the reverse direction $\beta$ about the pivot shafts 5, each fixed shaft 11, received in the retaining groove 8, is disengaged from the engagement wall 8A, and moves into the play region G to engage an opposite wall 8B whereupon the retaining lever 2 ceases to pivotally move in the reverse direction, and hence is held stationary in this position.

In this stationary condition, the retaining lever 2 is inclined an angle 8 from the properly-fitted condition, as shown in the drawings. Namely, the restoring force of the leaf springs 7 moves each fixed shaft 11, received in the retaining groove 8, toward the play region G, thereby inclining the retaining lever 2 in a conspicuous manner.

With this construction, the operator can easily realize the inclined condition of the retaining lever 2, and therefore the incompletely-fitted condition of the connectors can be easily confirmed.

Therefore, the operation efficiency can be greatly improved, and besides the cost of the connector can be reduced, and the cause of a malfunction can be reduced by the reduction of the constituent parts.

The above resiliently-deformable member comprises the leaf spring 7 of a resin formed integrally with the retaining lever 2, or the leaf spring 7 of a suitable size fixedly secured to the retaining lever 2 by conventional means such as an adhesive, rivets, screws or the like.

Other means than the spring engagement projection 6 can be used as the above limiting means.

For example, there may be provided an arrangement in which the front end portion is bent into a key-like projection, and a recess or a groove for receiving this key-like projection is formed in the relevant portion of the female connector 3.

In the above embodiment, although the lever for retaining purposes is provided on the female connector while the fixed shafts are provided on the male connector, the lever and the fixed shafts may be provided on the male and female connectors, respectively.

As described above, in the lever-type connector of the present invention, one connector, having the projected, fixed shafts at its opposite sides, is inserted into the other connector having the separate retaining lever mounted thereon by the pivot shafts provided at the opposite sides thereof, and when the retaining lever is pivotally moved forwardly, with the fixed shafts received respectively in the retaining grooves in the retaining lever, the resiliently-deformable member, which is mounted integrally or separately on the retaining lever, and can be held at its one end by the limiting means mounted on the other connector, is resiliently deformed in accordance with the pivotal movement, so that the restoring force thereof causes the fixed shafts, received respectively in the retaining grooves, to move respectively toward the play regions of the retaining grooves, thereby inclining the retaining lever in a conspicuous manner. Therefore, there is achieved an advantage that merely by confirming whether or not this inclination is present, it can be confirmed whether or not the incompletely-fitted condition is encountered. And besides, thanks to the provision of the play regions, the inclination of the retaining lever is conspicuous, and therefore the confirming operation is quite easy.

Because of these advantageous effects, there is achieved an advantage that the efficiency of the connector fitting/assembling operation can be greatly improved. Further, by integrally molding said resiliently-deformable member and the retaining lever by a resin, the number of the component parts, as well as the number of the steps of the assembling operation, can be reduced, and therefore the productivity can be improved greatly, and also the cost can be reduced greatly.

What is claimed is:

1. A lever connector comprising:

one connector having fixed shafts on opposite sides thereof;

the other connector having pivot shafts on opposite sides thereof;

a retaining lever pivotably disposed about the pivot shafts on the other connector, the retaining lever including retaining grooves, formed on the retaining lever, for retainingly fitting the fixed shafts, respectively, and a play region provided at each of the retaining grooves;

limiting means for holding one end of a resiliently-deformable member; and the resiliently-deformable member resiliently deformed by pivotally moving forwardly the retaining lever and holding the limiting means at one end thereof, wherein when the retaining lever is pivotally moved forwardly, with the fixed shafts being received respectively in the retaining grooves, the retaining lever is inclined for moving the fixed shafts toward the play regions by a restoring force of the resiliently-deformable member.

2. A lever connector according to claim 1, wherein the play regions are formed along one side edge of the retaining grooves, respectively.

3. A lever connector as claimed in claim 1, wherein the resiliently-deformable member includes a leaf spring.

4. A lever connector as claimed in claim 3, wherein the leaf spring is formed at rear side of the retaining lever.

5. A lever connector as claimed in claim 1, wherein the limiting means includes a spring engagement projection.

6. A lever connector as claimed in claim 5, wherein the spring engagement projection is provided adjacent to the pivot shafts.

7. A lever connector as claimed in claim 1, wherein the limiting means is disposed on the other connector, and the resiliently-deformable member disposed on the retaining lever.

8. A lever connector as claimed in claim 7, wherein the resiliently-deformable member is integrally formed on the retaining lever.

9. A lever connector as claimed in claim 7, wherein the resiliently-deformable member is separately formed on the retaining lever.

10. A lever connector as claimed in claim 1, wherein the limiting means is disposed on the retaining lever, and the resiliently-deformable member disposed on the other connector.

11. A lever connector as claimed in claim 10, wherein the resiliently-deformable member is integrally formed on the other connector.

12. A lever connector as claimed in claim 10, wherein the resiliently-deformable member is separately formed on the other connector.

* * * * *